US007125089B2

(12) United States Patent
Niwa

(10) Patent No.: US 7,125,089 B2
(45) Date of Patent: Oct. 24, 2006

(54) DRIVER DEVICE FOR A THERMAL PRINT HEAD

(75) Inventor: Isao Niwa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 11/063,605

(22) Filed: Feb. 24, 2005

(65) Prior Publication Data

US 2005/0191106 A1 Sep. 1, 2005

(30) Foreign Application Priority Data

Feb. 27, 2004 (JP) ..... 2004-053854

(51) Int. Cl.
*B41J 29/38* (2006.01)
*B41J 2/05* (2006.01)

(52) U.S. Cl. ..... 347/9; 347/59

(58) Field of Classification Search ..... 400/120; 347/9, 12, 59
See application file for complete search history.

(56) References Cited

U.S. PATENT DOCUMENTS 5,479,197 A * 12/1995 Fujikawa et al. ..... 347/63
5,602,576 A * 2/1997 Murooka et al. ..... 347/59
5,850,242 A * 12/1998 Asaba ..... 347/59
6,302,504 B1 * 10/2001 Imanaka et al. ..... 347/9

FOREIGN PATENT DOCUMENTS

JP 10-138484 5/1998

* cited by examiner

*Primary Examiner*—Andrew H. Hirshfeld
*Assistant Examiner*—Wasseem H. Hamdan
(74) *Attorney, Agent, or Firm*—Arent Fox PLLC

(57) ABSTRACT

A print head has m driver devices 1 that are fed with a supply voltage VDD and that control the driving of resistive elements acting as heaters and a regulator 2 that is fed with a supply voltage VH higher than the supply voltage VDD and that converts the supply voltage VH into a supply voltage VG, which the regulator 2 then feeds to the individual driver devices 1.

8 Claims, 5 Drawing Sheets

PRIOR ART

PRIOR ART

DRIVER DEVICE FOR A THERMAL PRINT HEAD

This application is based on Japanese Patent Application No. 2004-53854 filed on Feb. 27, 2004, the contents of which are hereby incorporated by reference.

BACKGROUND OF THE INVENTION

1. Field of the Invention

The present invention relates to a print head for printing on recording paper, and to a driver device for driving such a print head. More particularly, the present invention relates to a thermal print head for performing printing by a method based on thermal sensitivity, thermal transfer (including dye sublimation), or ink jetting, and to a driver device for driving such a print head.

2. Description of Related Art

A printing apparatus such as a facsimile machine or printer typically adopts one of the following printing methods: a thermal sensitivity based method, whereby a print head is pressed against heat-sensitive paper to achieve printing on the paper; a thermal transfer based method (including a dye sublimation based method), whereby heat from a print head is applied to an ink ribbon coated with solid ink so that printing is achieved by the ink subliming and settling on recording paper; and an ink jetting based method, whereby ink is emitted by bubbles formed by application of heat thereto so that printing is achieved by the fine particles of the ink thus emitted being blown onto recording paper. A printing apparatus adopting any of these methods is provided with, as a print head with which to achieve printing, a thermal print head having, as heating elements, resistive elements arranged in a row. Such a thermal print head is provided with a driver device for driving the resistive elements so that the resistive elements, arranged in a row, release heat according to print data.

One conventional example of such a thermal print head is a recording head incorporating a driver device provided with MOS transistors for feeding electric current to and thereby driving heaters built with resistive elements (see Japanese Patent Application Laid-Open No. H10-138484). This recording head disclosed in Japanese Patent Application Laid-Open No. H10-138484 is provided with a correction circuit that is formed by the same fabrication process as the heater driving MOS transistors. The purpose of this correction circuit is to prevent variations in the current flowing through the heaters that result from, among others, process-associated variations in the characteristics of the heater driving MOS transistors and variations in wiring resistance.

As shown in FIG. 8, in a conventional thermal print head, a plurality of driver devices 100 are provided so as to drive resistive elements arranged in a row on a group-by-group basis. As shown in FIG. 9, these driver devices 100 are each provided with: a shift register 101 that stores data consisting of as many bits as the resistive elements that the driver device needs to drive; a plurality of inverters Inv that feed the data of the individual bits of the shift register 101 to MOS transistors Tr; a plurality of MOS transistors Tr that drive the resistive elements; and output terminals Out via which the drains of the MOS transistors Tr are connected to the resistive elements.

In the thermal print head configured as described above, print data that is fed on a bit-by-bit basis to the shift registers 101 of the individual driver devices 100 is serially stored therein. At this time, the driver devices 100 bring their respective shift registers 101 into a write-enable state one by one so that the print data of different groups are stored in the shift registers 101 of the different driver devices 100. The print data thus stored on a bit-by-bit basis in the shift registers 101 is then fed on a bit-by-bit basis to the inverters Inv. Here, each bit of the print data corresponds to each dot printed. That is, the number of bits contained in the print data corresponds to the number of dots printed.

At this time, the inverters Inv are fed with the same supply voltage VDD as the shift registers 101, and either this supply voltage VDD or a ground voltage is fed to the gates of the MOS transistors Tr. In a case where the shift registers 101 each store n-bit data and there are provided m driver devices 100, the driver devices 100 are each provided with n inverters Inv and n MOS transistors Tr so that, altogether, they control the driving of n×m resistive elements corresponding to n×m bits in total.

At any bits where the print data outputted from the shift registers 101 is low, the supply voltage VDD is fed through the inverters Inv to the gates of the MOS transistors Tr. This turns the MOS transistors Tr on, and thus electric current is fed via the output terminals Out to the resistive elements, which thus release heat and thereby achieve printing. By contrast, at any bits where the print data outputted from the shift registers 101 is high, the ground voltage is fed through the inverters Inv to the gates of the MOS transistors Tr. This turns the MOS transistors Tr off, and thus no electric current is fed via the output terminals Out to the resistive elements, which thus release no heat.

In the thermal print head configured as shown in FIGS. 8 and 9, a relationship as shown in FIG. 10 is observed between the voltage fed to the gates of the MOS transistors Tr provided in the driver devices 100 and the on-state resistance of the MOS transistors Tr. Assume that the MOS transistors Tr are given a gate width of Wa, Wb, or Wc (Wa>Wb>Wc). Then, in FIG. 10, the solid line represents the relationship observed when the MOS transistors Tr are given a gate width of Wa, the broken line represents the relationship observed when the MOS transistors Tr are given a gate width of Wb, and the dash-and-dot line represents the relationship observed when the MOS transistors Tr are given a gate width of Wc. As will be clearly understood from FIG. 10, the lower the voltage fed to the gates of the MOS transistors Tr, and the smaller the gate width, the higher the on-state resistance attributable to the voltage fed to the gates of the MOS transistors Tr and the greater the variations in that resistance among different MOS transistors Tr.

Conventionally, the driver devices 100 are fed with a supply voltage of 3 V to 5 V, and thus this supply voltage of 3 V to 5 V is fed to the MOS transistors Tr. Accordingly, to reduce the influence of the on-state resistance of the MOS transistors Tr, the MOS transistors Tr need to be given a gate width as great as 2,100 μm. This makes the dimension of the driver devices, which is built as a semiconductor integrated circuit device, along the shorter sides of the chip thereof as large as 1,400 μm. Moreover, the lower the voltage fed to the gates of the MOS transistors Tr, the higher the on-state resistance attributable to the gate width of the MOS transistors.

In the recording head disclosed in Japanese Patent Application Laid-Open No. H10-138484 mentioned above, the correction circuit is provided to reduce the influence of the just-mentioned on-state resistance of MOS transistors. However, the voltage fed through this correction circuit is inevitably lower than the supply voltage because of the resistance through the correction circuit. This creates the need to increase the gate width of the MOS transistors to reduce the influence of the on-state resistance. Moreover, the correction circuit needs to be formed by the same fabrication process as the MOS transistor, and therefore needs to be provided individually in each driver device. Thus, in a thermal print head provided with a plurality of driver devices, the region in which to form the correction circuit needs to be secured in each driver device. This hinders downsizing of the driver devices.

SUMMARY OF THE INVENTION

In view of the conventionally encountered problems described above, it is an object of the present invention to provide a driver device that is so designed as to reduce the influence of the on-state resistance of driving transistors resulting from variations in the voltage fed to the control electrodes of the transistors or variations in the characteristics of the control electrodes, and to provide a print head provided with such a driver device.

To achieve the above object, in one aspect of the present invention, a driver device is provided with: n transistors for individually driving n heating elements; a data storage for storing n-bit data according to which the n transistors are turned on and off; and n level shifters for converting the voltages of the individual bits of the n-bit data from first voltages with which the n-bit data is received from the data storage into second voltages higher than the first voltages and then outputting the second voltages to the control electrodes of the n transistors. Here, the second voltages are fed from a regulator.

In another aspect of the present invention, a driver device is provided with: n transistors for individually driving heating elements; a data storage that receives first voltages and that stores n-bit data according to which the n transistors are turned on and off; a regulator that produces second voltages higher than the first voltage; and n level shifters that receive the second voltages from the regulator and that convert, from the first voltages to the second voltages, voltages of individual bits of the n-bit data fed from the data storage and then output the n bit data having the voltages thereof converted to control electrodes of the n transistors, wherein the second voltages produces by the regulator are fed to another driver device provided with no regulator.

In still another aspect of the present invention, a print head is provided with: a regulator for producing second voltages higher than the first voltages with which n-bit print data is fed in from outside; and m driver devices. The m drivers each include: n transistors for individually driving n heating elements; a data storage for storing the n-bit print data according to which the n transistors are turned on and off; and n first level shifters for converting the voltages of the individual bits of the n-bit print data into the second voltages fed from the regulator and then outputting the second voltages to the control electrodes of the n transistors.

In a further aspect of the present invention, a print head is provided with: m driver devices. The m driver devices each include: n transistors for individually driving n heating elements; a data storage for storing n-bit print data according to which the n transistors are turned on and off; and n first level shifters for converting the voltages of the individual bits of the n-bit print data into the second voltages fed from a regulator and then outputting the second voltages to the control electrodes of the n transistors. Here, one of the driver devices includes the regulator for producing the second voltages higher than the first voltages with which n-bit print data is fed in from outside.

According to the present invention, the second voltages are made high enough to permit the on-state resistance of the transistors to be so stable to hardly vary with variations in the voltage fed to the control electrodes of the transistors. This helps reduce variations in the current that is passed through the resistive elements acting as heating elements. Here, using MOS transistors as the transistors helps stabilize the on-state resistance even when the MOS transistors are given a small gate width. This contributes to downsizing of driver devices and print heads.

Moreover, in a case where MOS transistors are used as the transistors, the second voltages are made high enough to permit the on-state resistance of the transistors to hardly vary with variations in the gate width. This helps reduce the influence of the gate width of the transistors even among driver devices that have not been formed by the same fabrication process, and thus helps reduce variations in the current that is passed through the resistive elements acting as heating elements.

DETAILED DESCRIPTION OF PREFERRED EMBODIMENTS

First Embodiment

Figure 1:
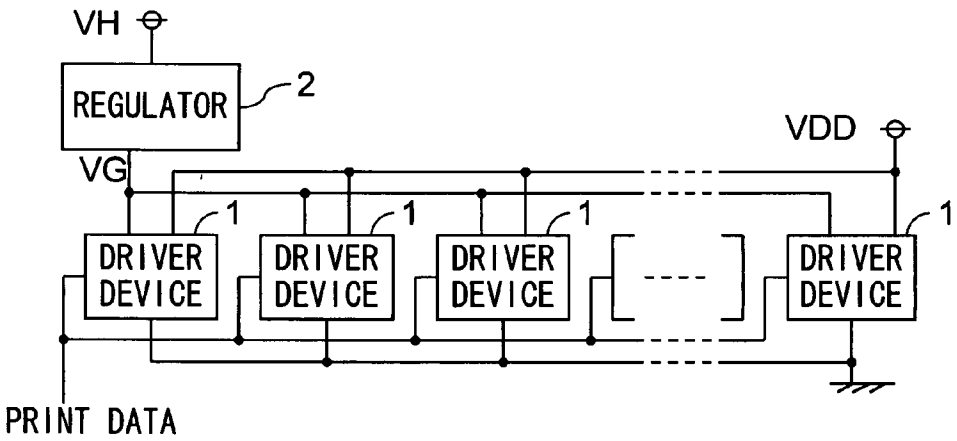
FIG. 1 is a block diagram showing the internal configuration of the print head of a first embodiment.
Figure 2:
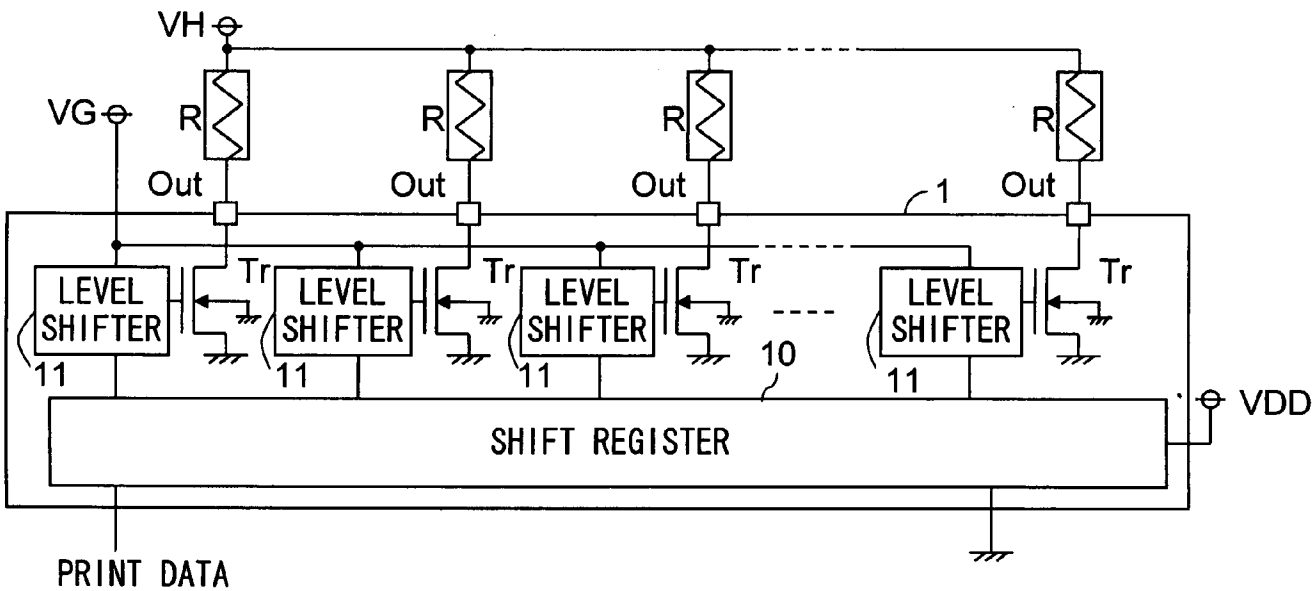
FIG. 2 is a block diagram showing the internal configuration of the driver device provided in the print head shown in FIG. 1.
Figure 9:
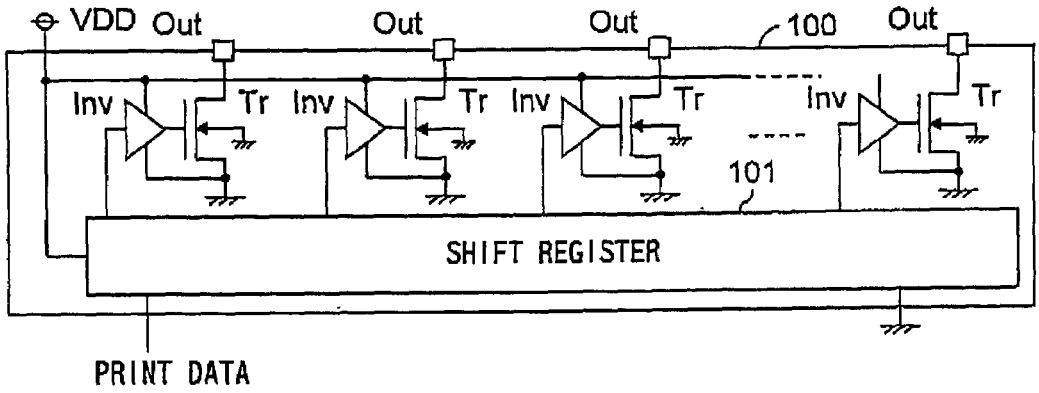
FIG.9 PRIOR ART
FIG. 9 is a block diagram showing the internal configuration of the driver device provided in the print head shown in FIG. 8.

A first embodiment of the present invention will be described below with reference to the relevant drawings. FIG. 1 is a block diagram showing the configuration of the print head of this embodiment, and FIG. 2 is a block diagram showing the configuration of the driver device provided in the print head shown in FIG. 1. In the driver device shown in FIG. 2, such circuit elements and components that serve the same purposes as in the driver device shown in FIG. 9 are identified with common reference numerals or symbols, and their detailed explanations will not be repeated.

The print head shown in FIG. 1 is provided with: m driver devices 1 that are fed with a supply voltage VDD and that control the driving of resistive elements R that, as will be described later, act as heaters; and a regulator 2 that is fed with a supply voltage VH higher than the supply voltage VDD and that converts the supply voltage VH into a voltage VG, which the regulator 2 then feeds to the individual driver devices 1. In this configuration, the supply voltage VDD and the voltage VG, which are both fed to the driver devices 1, fulfill the relationship VG>VDD.

Here, the driver devices 1 are built as one semiconductor integrated circuit device, and the regulator 2 is built as another. That is, the print head is provided with a semiconductor integrated circuit device incorporating n driver devices 1 and a semiconductor integrated circuit device incorporating one regulator 2. In this embodiment, it is assumed, as a mere example, that the supply voltage VDD is 3 V to 5 V, that the supply voltage VH is 24 V, and that the voltage VG is 14 V. As will be described later, the supply voltage VH is a supply voltage that is used as a heater supply power.

The driver devices 1 provided in this print head are each provided with: a shift register 10 that stores n-bit print data that is serially fed thereto; n level shifters 11 to which the data of the individual bits are respectively fed from the shift register 10; n n-channel MOS transistors Tr to the gates of which the voltage signals outputted from the n level shifters 11 are respectively fed and of which the sources are grounded; and output terminals Out that are respectively connected to the drains of the n MOS transistors Tr.

The driver devices 1 are configured as described above, and their output terminals Out are respectively connected to one ends of resistive elements R that act as heaters. These resistive elements R receive, at the other ends thereof, the supply voltage VH as a heater supply power. Thus, the n×m print data that is fed from outside to the print head provided with m such driver devices 1 are stored, in m groups of print data each consisting of n bits, in the shift registers 10 of the m driver devices 1.

In each of the m driver devices 1, the n bit print data stored in the shift register 10 is fed through the level shifters 11 to the gates of the MOS transistors Tr to turn these MOS transistors Tr on and off. At this time, electric current is passed through those resistive elements R which are connected to the output terminals Out with respect to which the MOS transistors Tr are turned on, so that those resistive elements R release heat. In this way, the driving of the n×m resistive elements R is controlled to achieve printing.

At this time, since the shift register 10 is fed with the supply voltage VDD, the print data of the individual bits outputted from the shift register 10 has voltage levels between the ground voltage and the supply voltage VDD. That is, in each of the signal values of the n-bit print data fed parallel from the shift register 10 to the n level shifters 11, the amplitude voltage equals the supply voltage VDD. When the n-bit data outputted from the shift register 10 is fed on a bit-by-bit basis to the n level shifters 11, since the level shifters 11 are fed with the voltage VG, the level shifters 11 converts the amplitude voltage, which originally equals the supply voltage VDD, into a new amplitude voltage that equals the voltage VG. That is, the level shifters 11 shift the levels of the voltages fed to the MOS transistors Tr from the supply voltage VDD to the voltage VG.

Figure 10:
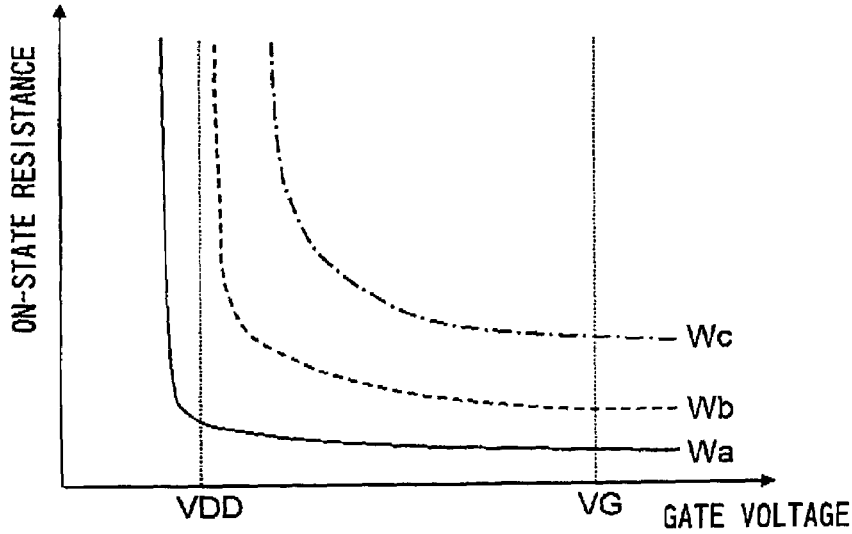
FIG. 10 is a graph showing the relationship between the gate voltage of a MOS transistor and the on-state resistance thereof.

When the signal values of which the amplitude voltage equals the voltage VG are fed from the level shifters 11 to the MOS transistors Tr in this way, those MOS transistors Tr which are fed with signal values that equal the voltage VG are turned on, and those MOS transistors Tr which are fed with signal values that equal the ground voltage are turned off. When the MOS transistors Tr are fed with signal values of which the amplitude voltage equals the voltage VG in this way, as will be understood from FIG. 10, the on-state resistance of the MOS transistors Tr remains lower and more stable than ever, with little variation. Now, the MOS transistors Tr can be given a gate width of approximately 870 μm, and the dimension of the semiconductor integrated circuit device incorporating the driver devices 1 along the shorter sides of the chip thereof can be made approximately 1,100 μm long, thus achieving downsizing of the chip size.

Even if there exist slight variations in the gate width of the MOS transistors Tr among the different driver devices 1, they produce only slight variations in the on-state voltage. Thus, there is no need to provide a correction circuit as disclosed in Japanese Patent Application Laid-Open No. H10-138484. Moreover, sharing a single regulator 2 to produce the voltage VG fed to the level shifters 11 provided in all the m driver devices 1, as compared with providing a regulator in each driver device, helps reduce the device area occupied by the regulator in the print head to 1/m. Furthermore, building the regulator 2 as a semiconductor integrated circuit device separate from the driver devices 1 makes it possible to select the optimum fabrication line in terms of functions and costs.

Second Embodiment

Figure 3:
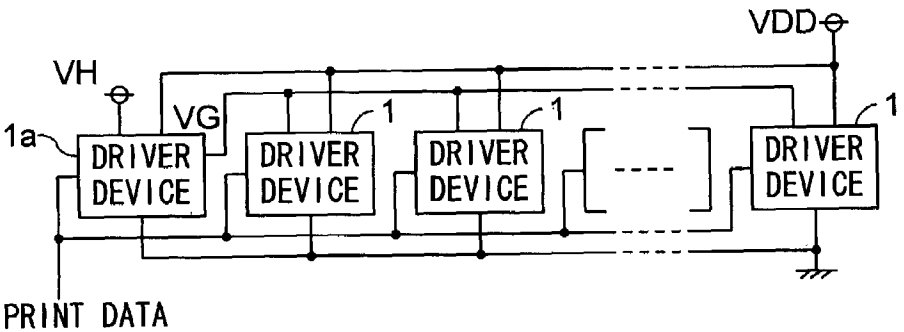
FIG. 3 is a block diagram showing the internal configuration of the print head of a second embodiment.
Figure 4:
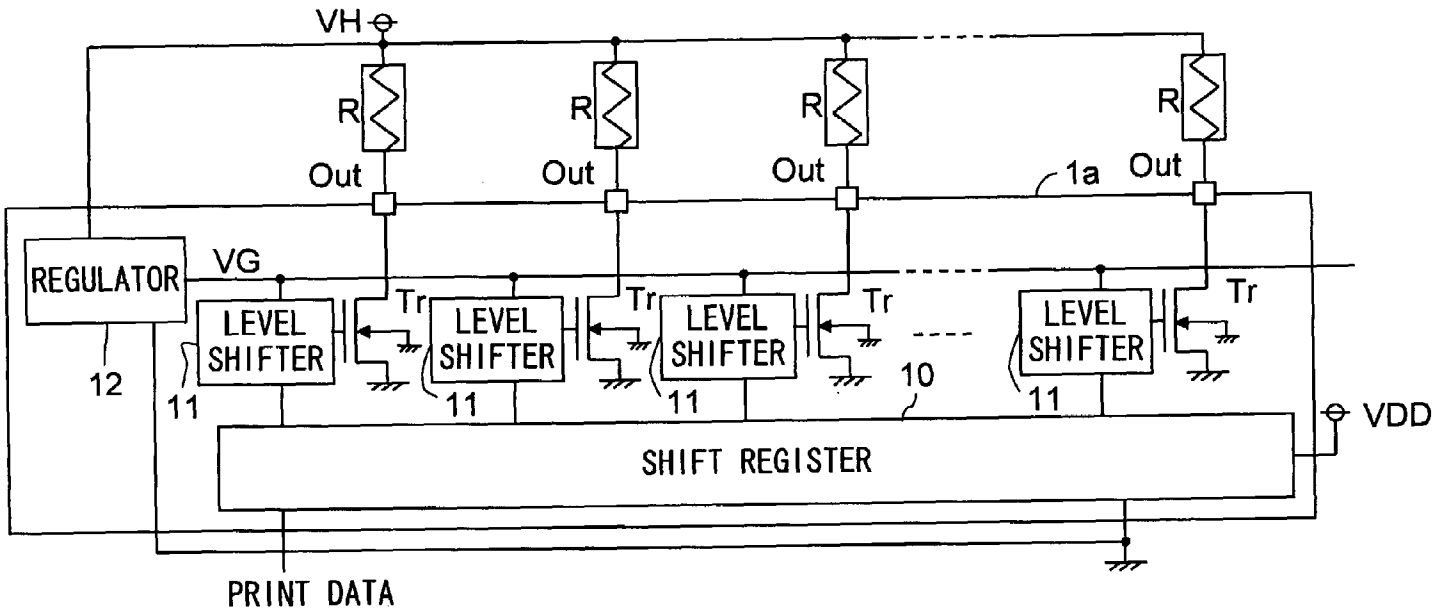
FIG. 4 is a block diagram showing the internal configuration of the driver device provided in the print head shown in FIG. 3.

A second embodiment of the present invention will be described below with reference to the relevant drawings. FIG. 3 is a block diagram showing the configuration of the print head of this embodiment, and FIG. 4 is a block diagram showing the configuration of the driver device provided in the print head shown in FIG. 4. In the print head shown in FIG. 3 and the driver device shown in FIG. 4, such circuit elements and components that serve the same purposes as in the print head shown in FIG. 1 and the driver device shown in FIG. 2 are identified with common reference numerals or symbols, and their detailed explanations will not be repeated.

The print head shown in FIG. 3 is provided with: m−1 driver devices 1; and a drive device 1*a* that is fed with supply voltages VDD and VH and that feeds a voltage VG to the m−1 driver devices 1. In this configuration, as shown in FIG. 4, the drive device 1*a* is provided with a shift register 10; n level shifters 11; n MOS transistors Tr; n output terminals Out; and a regulator 12 that converts the supply voltage VH, used as a heater supply voltage, into a voltage VG, which the regulator 12 then feeds to the n level shifters 11 and to the m−1 driver devices 1. On the other hand, the driver devices 1 are, like those used in the first embodiment, configured as shown in FIG. 2, and the voltage VG fed from the regulator 12 of the drive device 1*a* is fed to all the level shifters 11 provided in the driver devices 1.

In this configuration, the regulator 12 provided in the drive device 1*a* feeds the supply voltage VG to the n×m level shifters 11 provided in the drive device 1*a* and in the m−1 driver devices 1. Thus, when the n-bit print data outputted from the m shift registers 10 provided in the drive device 1*a* and in the m−1 driver devices 1 is fed on a bit-by-bit basis to the level shifters 11, the level of the amplitude voltage of the print data is shifted from the supply voltage VDD to the voltage VG.

Thus, signal values of which the amplitude voltage equals the voltage VG are fed to the gates of the n×m MOS transistors Tr provided in the drive device 1*a* and in the m−1 driver devices 1 so that those MOS transistors Tr which are fed with signal values that equal the voltage VG are turned on, and those MOS transistors Tr which are fed with signal values that equal the ground voltage are turned off. In this way, also in this embodiment, as in the first embodiment, the MOS transistors Tr are fed with signal values of which the amplitude voltage equals the voltage VG, and this permits the on-state resistance of the MOS transistors Tr to remain lower and more stable than ever, with little variation. Now, the MOS transistors Tr can be given a gate width of approximately 870 μm, and the dimension of the semiconductor integrated circuit device incorporating the driver devices 1 along the shorter sides of the chip thereof can be made approximately 1,100 μm long, thus achieving downsizing of the chip size.

Third Embodiment

Figure 5:
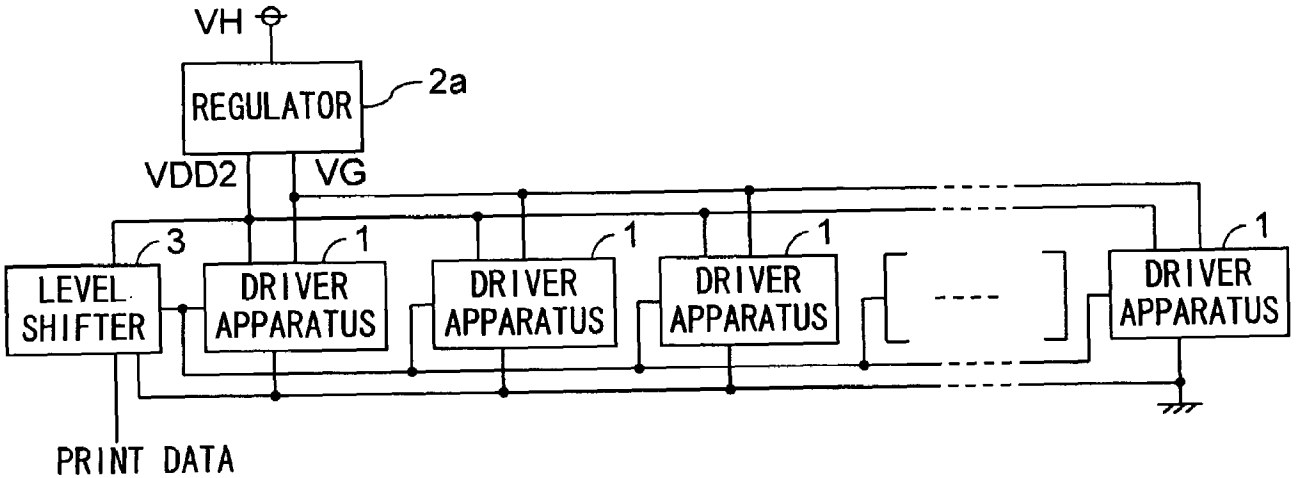
FIG. 5 is a block diagram showing the internal configuration of the print head of a third embodiment.

A third embodiment of the present invention will be described below with reference to the relevant drawings. FIG. 5 is a block diagram showing the configuration of the print head of this embodiment. In the print head shown in FIG. 5, such circuit blocks that serve the same purposes as in the print head shown in FIG. 1 are identified with common reference numerals or symbols, and their detailed explanations will not be repeated.

The print head shown in FIG. 5 is provided with: m driver devices 1; a regulator 2*a* that is fed with a supply voltage VH and that feeds voltages VDD2 and VG to the m driver devices 1 and to a level shifter 3; and the level shifter 3 that converts the amplitude voltage of print data fed in from outside from a voltage VDD into the VDD2 (VDD2>VDD), which the level shifter 3 then feeds to the m driver devices 1. In this embodiment, it is assumed, as a mere example, that the voltage VDD is 6 V to 7 V so as to be higher than the voltage VDD, which is 3 V to 5 V.

In the print head configured as described above, the voltage VDD2 outputted from the regulator 2*a* is fed to the shift registers 10 provided in the regulator 2 and in the m driver devices 1. Moreover, the voltage VG outputted from the regulator 2*a* is fed to the n level shifters 11 provided in the m driver devices 1. Thus, the level shifter 3 first shifts, on a bit-by-bit basis, the level of the amplitude voltage of the print data fed in from outside from the supply voltage VDD to the voltage VDD2 and then feeds the converted print data, n bits by n bits, to the shift registers 10 of the m driver devices 1.

When the print data having the level of the amplitude voltage thereof shifted to the voltage VDD2 fed from the regulator 2*a* is stored in the shift registers 10 of the driver devices 1 in this way, since these shift registers 10 are also fed with the voltage VDD2 from the regulator 2*a*, in each driver device 1, n-bit print data of which the amplitude voltage equals voltage VDD2 is fed to the n level shifters 11. Then, as in the first embodiment, the individual level shifters 11 thus fed with the print data feed signal values obtained by shifting the level from the voltage VDD2 to the voltage VG to the gates of the MOS transistors Tr.

In this way, also in this embodiment, signal values of which the amplitude voltage equals the voltage VG are fed to the gates of the n×m MOS transistors Tr provided in the m driver devices 1, and thus, as in the first embodiment, the MOS transistors Tr are fed with signal values of which the amplitude voltage equals the voltage VG. This permits the on-state resistance of the MOS transistors Tr to remain lower and more stable than ever, with little variation. Now, the MOS transistors Tr can be given a gate width of approximately 870 μm, and the dimension of the semiconductor integrated circuit device incorporating the driver devices 1 along the shorter sides of the chip thereof can be made approximately 1,100 μm long, thus achieving downsizing of the chip size. Moreover, in this embodiment, the print data is fed to the driver devices 1 after the level has been shifted by the level shifter 3. This permits the shift registers 10 and other components to operate faster thanks to higher voltages, without the need to change the process (withstand voltage) of the driver devices 1.

Figure 6:
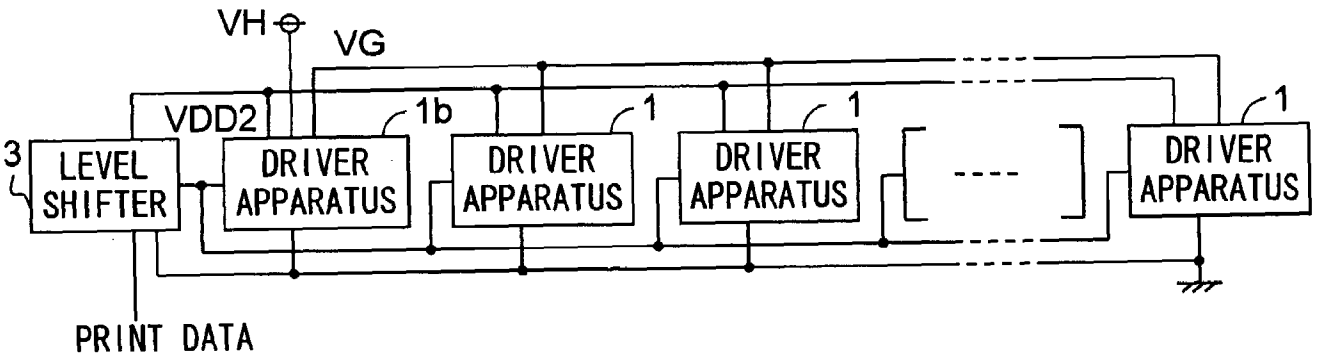
FIG. 6 is a block diagram showing the internal configuration of another example of the print head of a third embodiment.

In this embodiment, as in the second embodiment, the print head may be provided with, as shown in FIG. 6, one driver device 1*b* in combination with m−1 driver devices 1 so that voltages VDD2 and VG produced from a supply voltage VH by the driver device 1*b* are fed to the driver devices 1. This print head shown in FIG. 6, like the print head shown in FIG. 5, is further provided with a level shifter 3, and the voltage VDD2 produced by the driver device 1*b* is fed to the level shifter 3.

Figure 7:
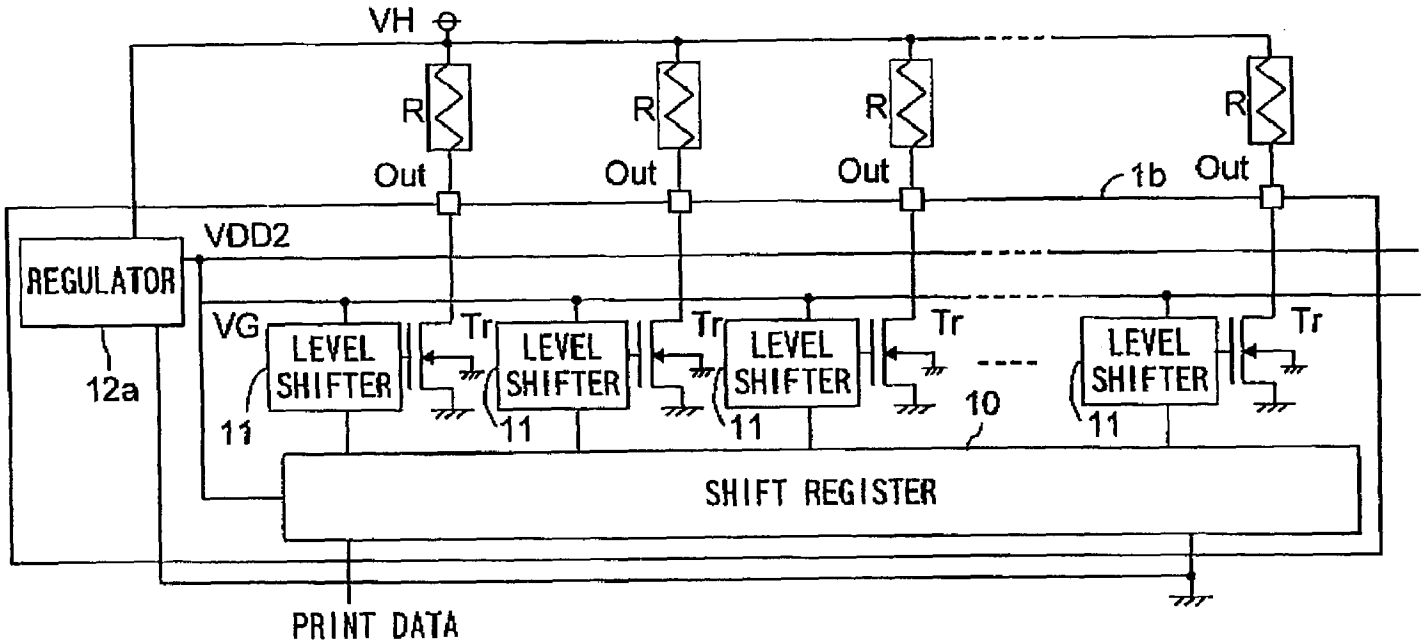
FIG. 7 is a block diagram showing the internal configuration of the driver device provided in the print head shown in FIG. 6.
Figure 8:
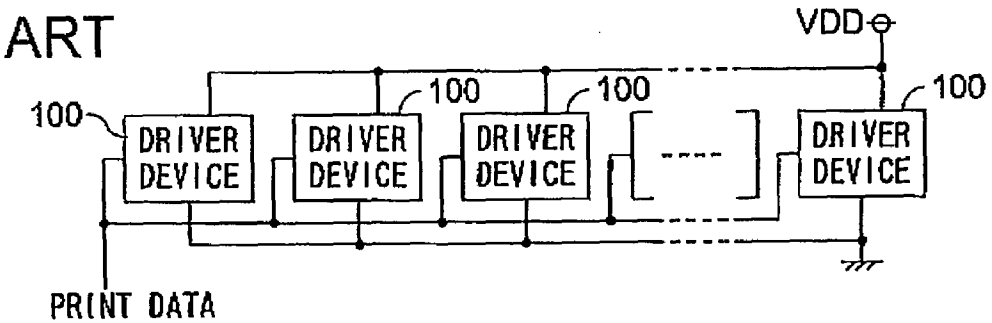
FIG. 8 is a block diagram showing the internal configuration of a conventional print head.

In this case, as shown in FIG. 7, the driver device 1*b* is provided with, instead of the regulator 12 provided in the drive device 1*a* shown in FIG. 4, a regulator 12*a* that produces the voltages VDD2 and VG from the supply voltage VH. The voltage VDD2 produced by the regulator 12*a* is fed to the shift register 10, and the voltage VG produced by the regulator 12*a* is fed to the n level shifters 11.

Driver devices and print heads according to the present invention find application in printing apparatuses, such as facsimile machines, printers, copiers, and multi-function printing apparatuses, that adopt printing methods based on thermal sensitivity, thermal transfer including dye sublimation, and ink jetting.

What is claimed is:

1. A driver device comprising:

n transistors for individually driving n heating elements;

a data storage that receives first voltages and that stores n-bit data according to which the n transistors are turned on and off; and n level shifters that receive, from an externally provided regulator, second voltages higher than the first voltages and that convert, from the first voltages to the second voltages, voltages of individual bits of the n-bit data fed from the data storage and then output the n-bit data having the voltages thereof converted to control electrodes of the n transistors;

wherein the second voltages are fed from the regulator.

2. The driver device of claim 1, wherein the second voltages are produced from a supply voltage fed to resistive elements that act as the heating elements.

3. The driver device of claim 1, wherein the regulator produces the first voltages and feeds the first voltages to the data storage.

4. The driver device of claim 3, wherein the regulator outputs the first voltages by producing the first voltages from a supply voltage that is fed to resistive elements that act as the heating elements.

5. A driver device comprising:

n transistors for individually driving n heating elements;

a data storage that receives first voltages and that stores n-bit data according to which the n transistors are turned on and off;

a regulator that produces second voltages higher than the first voltage; and n level shifters that receive the second voltages from the regulator and that convert, from the first voltages to the second voltages, voltages of individual bits of the n-bit data fed from the data storage and then output the n-bit data having the voltages thereof converted to control electrodes of the n transistors, wherein the second voltages produced by the regulator are fed to another driver device provided with no regulator.

6. The driver device of claim 5, wherein the second voltages are produced from a supply voltage fed to resistive elements that act as the heating elements.

7. The driver device of claim 5, wherein the regulator produces the first voltages and feeds the first voltages to the data storage.

8. The driver device of claim 7, wherein the regulator outputs the first voltages by producing the first voltages from a supply voltage that is fed to resistive elements that act as the heating elements.

* * * * *